US006284306B1

(12) United States Patent
Oomen et al.

(10) Patent No.: US 6,284,306 B1
(45) Date of Patent: Sep. 4, 2001

(54) METHOD OF MANUFACTURING A FILTERING LAYER OF SILICON DIOXIDE ON A DISPLAY SCREEN

(75) Inventors: Emmanuel W. J. L. Oomen; Joseph G. Van Lierop, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 08/433,664

(22) Filed: May 4, 1995

Related U.S. Application Data

(62) Division of application No. 08/170,472, filed on Dec. 20, 1993.

(30) Foreign Application Priority Data

Dec. 21, 1992 (EP) ..... 92204041

(51) Int. Cl.[7] ..... B05D 5/12

(52) U.S. Cl. ..... 427/64; 427/106; 427/108; 427/126.3

(58) Field of Search ..... 427/64–69, 126.3, 427/126.4, 106, 108, 110

(56) References Cited

U.S. PATENT DOCUMENTS

| | | | | |
|---|---|---|---|---|
| 4,243,398 | | 1/1981 | Nomura | 65/2 |
| 4,313,648 | | 2/1982 | Yano | 350/166 |
| 4,787,716 | * | 11/1988 | Kato et al. | 350/357 |
| 4,822,144 | | 4/1989 | Vriens | 350/339 F |
| 4,841,372 | * | 6/1989 | Lee | 358/247 |
| 4,945,282 | * | 7/1990 | Kawamura et al. | 313/479 |
| 4,946,592 | | 8/1990 | Galaj | 210/490 |
| 4,987,338 | * | 1/1991 | Itou et al. | 313/478 |
| 5,045,418 | | 9/1991 | Fukuyoshi | 430/7 |
| 5,291,097 | * | 3/1994 | Kawamura et al. | 313/478 |
| 5,449,534 | * | 9/1995 | Oishi et al. | 427/512 |

FOREIGN PATENT DOCUMENTS

| | | | |
|---|---|---|---|
| 0517611 | | 9/1992 | (EP) . |
| 517611 | * | 12/1992 | (EP) . |
| 0517611 | | 12/1992 | (EP) ..... H01J/29/86 |

OTHER PUBLICATIONS

Sesarch Report.

* cited by examiner

*Primary Examiner*—Brian K. Talbot
(74) *Attorney, Agent, or Firm*—Ernestine C. Bartlett

(57) ABSTRACT

The display screen 32 of a cathode ray tube is provided with a filtering layer consisting of silicon dioxide, an oxide of Ge, Zr, Al or Ti and a black dye. The filtering layer obtained may be mirror bright, is resistant to light and to customary cleaning liquids.

5 Claims, 1 Drawing Sheet

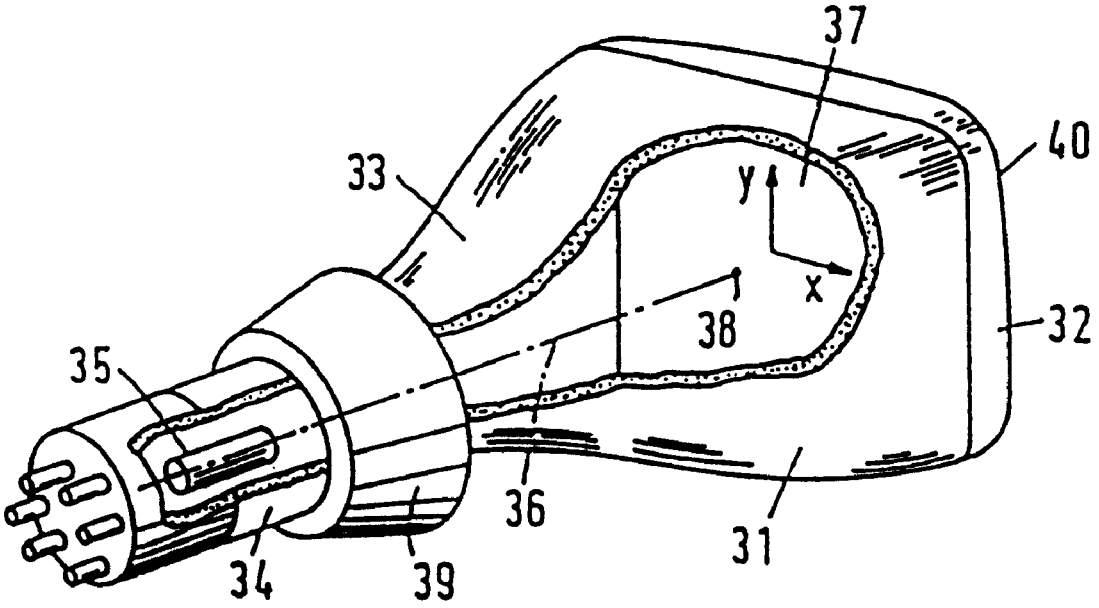
37
40
33
y
x
38
32
35
36
31
34
39

METHOD OF MANUFACTURING A FILTERING LAYER OF SILICON DIOXIDE ON A DISPLAY SCREEN

This is a division of application Ser. No. 08/170,2472, filed Dec. 20, 1993 pending.

The invention relates to a display device comprising a display screen which is provided with a filtering layer of silicon dioxide and a dye.

The invention also relates to a method of manufacturing a filtering layer of silicon dioxide on a display screen of a display device.

Filtering layers serving to reduce the light transmission are used on the faceplates of display devices, such as cathode ray tubes (CRTs) and liquid crystal display devices (LCD and LC-TV), to improve the contrast of the reproduced image. By virtue thereof, there is no necessity to change the glass composition of the display screen and the possibilities of bringing the light transmission to a desired value in a simple manner are increased. Such filtering layers reduce the transmission of both incident ambient light and light originating from CRT phosphors. As the filtering layers can be provided in a uniform manner, the transmission of the filtering layers is also uniform. The incident ambient light passes through the filtering layer and the glass display screen, after which it reflects off the rough phosphor layer on the inside of the display screen and again passes through the display screen and the filtering layer. If the transmissivity of the filtering layer is designated as T, the intensity of the reflected ambient light is reduced by a factor of $T^2$. Light originating from CRT phosphors passes through the filtering layer only once, so that the intensity of this light is reduced by only a factor of T, resulting in an increase of the contrast by a factor of T.

In U.S. Pat No. 4,987,338 a description is given of a cathode ray tube having a display screen provided with a filtering layer consisting of silicon dioxide and a dye having a selective light absorption which is maximal in the wavelength range of 575±20 nm. Said Patent Specification also describes a method of manufacturing such a layer. In said method an alcoholic solution of an alkoxysilane compound, such as tetraethyl orthosilicate $Si(OC_2H_5)_4$ (TEOS), acidified with hydrochloric acid and to which a dye is added, is spin coaled onto a display screen. In this case, for example Rhodamine B is used as the dye. Silicon dioxide starts forming in said solution. By a treatment at an increased temperature, the formation of silicon dioxide is completed and a layer of silicon dioxide which also contains the dye is formed.

A disadvantage of the known filtering layer is its purplish-violet appearance which in the case of much ambient light leads to an undesired purplish background of the reproduced image. A further disadvantage of the known dyes used is that they are not resistant to light, so that when the layer is exposed to ambient light the transmission of the layer increases with passage of time, and hence the contrast-increasing effect decreases.

It is an object of the invention to provide, inter alia, a display device having a display screen which is provided with a filtering layer which has a non-coloured appearance, which is resistant to prolonged exposure to ambient light and to customary cleaning liquids such as ethanol and ammonium hydroxide and which additionally has the desired scratch resistance. The invention also aims at providing a simple method of manufacturing such a filtering layer on a display screen, which filtering layer may have, if desired, a high-gloss appearance.

This object is achieved by a display device as described in the opening paragraph, which is characterized according to the invention in that the dye is black and in that the layer also contains an oxide of a metal selected from the group formed by Ge, Zr, Al and Ti. By incorporating a black dye in the oxidic filtering layer, the display screen obtains a neutral appearance which varies from light grey to black, depending on the concentration of said black dye. Many known black dyes are unsuitable because they are insoluble in the alcoholic solution of the alkoxysilane compounds used. Other so-called black dyes exhibit a blue or brown colour, instead of a black colour, in the filtering layer. Black dyes which are suitable for use in accordance with the invention are Orasol Black CN™ (Colour Index: Solvent Black 28) and Orasol Black RL™ (Colour Index: Solvent Black 29) available from Ciba Geigy; Zapon Black X51™ (Colour Index: Solvent Black 27) available from BASF and Lampronol Black™ (Colour Index: Solvent Black 35) available from ICI. Said dyes enable high-gloss black filtering layers to be manufactured. A very suitable dye is Orasol Black CN™ (Colour Index: Solvent Black 28) because it has a high resistance to light. The chemical structural formula of the latter dye is unknown; according to the information provided by the supplier it is a mono-azo chromium complex. Dependent upon the desired transmission, the filtering layer comprises dye stuff in a quantity of 1–15% by weight. In the wavelength range between 410 and 680 nm the transmission of the filtering layer comprising said dye is substantially constant and hence spectrally neutral. It has been found that these and other dyes can readily be leached when the filtering layer is in contact with customary cleaning liquids such as ethanol, acetone, diluted acetic acid, ammonium hydroxide, soap and salt water. By incorporating an oxide of Ge, Zr, Al or Ti or a mixture of one or more than one of said metal oxides in the silicon dioxide, a filtering layer is obtained which is better resistant to leaching of the dye. The above metal oxides can be incorporated in the filtering layer on the basis of a mixture of an alkoxysilane and a corresponding alkoxy compounds of said metals, such as tetraethyl orthogermanate $Ge(OC_2H_5)_4$ (TEOG), tetrabutyl orthozirconate $Zr(OC_4H_9)_4$ (TBOZ), tetrapropyl orthozirconate $Zr(OC_3H_7)_4$ (TPOZ), tripropyl orthoaluminate $Al(OC_3H_7)_3$ (TPOAl) and tetraethyl orthotitanate $Ti(OC_2H_5)_4$ (TEOTi) in an alcoholic solution. The filtering layer is formed in the hereinafter described manner.

In a favourable embodiment the filtering layer comprises 2–15 mole %, preferably 5–12 mole %, of germanium oxide or zirconium oxide in relation to silicon dioxide. Below 5 mole % the filtering layer is less resistant to cleaning liquids and above 15 mole % no further improvement of the resistance to leaching is obtained and the filtering layer becomes unnecessarily expensive. In addition, above 15 mole % of zirconium oxide, there is a greater risk of gellification of the alcoholic solution after a few hours at room temperature, which would render the solution unsuitable for further processing.

According to the invention, the object of providing a method of manufacturing a filtering layer of silicon dioxide on a display screen of a display device is achieved in that the filtering layer is manufactured by providing, on the display screen, an alcoholic solution of an alkoxysilane compound, an alkoxy compound of at least one metal selected from the group formed by Ge, Zr, Al and Ti, acidified water and a black dye, followed by a treatment at an increased temperature, thereby forming the filtering layer comprising silicon dioxide, an oxide of the metal and the dye.

A suitable alkoxysilane compound for use in the method in accordance with the invention is tetraethyl orthosilicate (TEOS). Other alkoxysilane compounds of the type $Si(OR)_4$, which are known per se, and oligomers thereof can alternatively be used, wherein R represents an alkyl group, preferably a $C_1$–$C_5$ alkyl group. Preferably, the alcoholic solution is applied to the display screen by spin coating. After drying and heating to, for example, 160° C. for 30 minutes a grey to black, smooth and high-gloss filtering layer is obtained in this manner. To obtain a homogeneous, smooth layer it may be beneficial to add a surface-active substance, for example in quantities of from 0.001 to 5 % by weight, to the solution. If desired, the alcoholic solution can be applied by spraying, thereby forming a mat filtering layer having anti-glare properties. For the alcohol, use can be made of ethanol, propanol, butanol, diacetone alcohol or a mixture thereof. Using acidified water the alkoxy groups of Si and the above-mentioned metals are converted into hydroxy groups by hydrolysis. Said hydroxy groups react with each other and with hydroxy groups of the glass surface of the display screen. During drying and heating, polycondensation brings about a satisfactorily adherent oxidic network of silicon dioxide in which oxides of one or more than one of the metals Ge, Zr, Al and Ti and the dye are incorporated. For the alkoxy compounds of the said metals use is made of compounds of the formula:

$$M(OR)_n,$$

where M=Ge, Zr, Al or Ti; R=$C_1$–$C_5$ alkyl group and n is the valency of the metal M. The above-mentioned compounds TEOG, TBOZ, TPOZ, TPOAl and TEOTi can be used by way of example. Preferably Orasol Black CN™ (Colour Index: Solvent Black 28) is used as the black dye because it has the above-mentioned favourable properties.

In a favourable embodiment of the method in accordance with the invention, 0.25–1 mole of acetylacetone (2,4-pentanedione) per mole of alkoxy compound of Ge, Zr, Al or Ti is also added to the alcoholic solution. This addition leads to an improved abrasion resistance of the filtering layer formed. The enol form of acetylacetone forms a complex with the metal M, as a result of which the velocity of the hydrolysis reaction and condensation reaction of the relevant M compound is reduced by steric hindrance. This effect promotes the formation of ≡Si—O—M≡ bonds at the expense of the formation of ≡M—O—M≡ bonds, so that covalent incorporation of the metal M into the silica network takes place more readily than the formation of oxide particles by the metal M.

It is assumed that fewer and/or smaller M-oxide particles have a favourable effect on the abrasion resistance. Too much acetylacetone may cause corrosion of the metal vessels and pipelines used, whereas too small a quantity of acetylacetone causes long filtration times of the coating solution due to the formation of many and/or large M-oxide particles. A quantity of 0.5 mole of acetylacetone per mole of M-alkoxy compound is optimal.

If desired, a filtering layer having antistatic properties can be obtained by adding a conductive metal oxide such as tin oxide, indium oxide or antimony oxide, the oxide being suspended in the alcoholic solution of the alkoxy compounds. It is alternatively possible to provide the filtering layer on a separate transparent front plate instead of on the display screen itself.

The invention will be explained in greater detail by means of exemplary embodiments and a drawing, in which the sole Figure is a partly exploded perspective view of an embodiment of a cathode ray tube in accordance with the invention.

EXEMPLARY EMBODIMENT 1.

Preparation of Germanium Alkoxide Liquid

A quantity of 5 grams of tetraethoxygermanate (TEOG) is added to a solution of 2.5 grams of Orasol Black CN™ (supplier Ciba Geigy) in 100 grams of ethanol and 100 grams of 1-butanol. In addition, a solution is prepared which comprises 100 grams of ethanol, 50 grams of tetraethoxy silane (TEOS) and 8 grams of water acidified with 1 N of HCl. After a reaction time of 30 minutes the two solutions are mixed. After 15 minutes a mixture of 8 grams of water acidified with 1 mole/l of HCl, 50 grams of ethanol and 50 grams of diacetone alcohol is added. After a reaction time of 6 hours, the mixture obtained is passed through a PTFE-filter having a pore size of 0.2 μm.

Preparation of Titanium Alkoxide Liquid

A quantity of 5 grams of tetraethoxy titanate (TEOTi) is added to a solution of 2.3 grams of Orasol Black CN™ in 100 grams of ethanol and 100 grams of 1-butanol. In addition, a solution is prepared which comprises 100 gram of ethanol, 50 grams of TEOS and 8 grams of water acidified with 1 mole/l of HCl. After a reaction time of 30 minutes, the two solutions are mixed. After 15 minutes, a mixture of 8 grams of water acidified with 1 mole of HCl, 50 grams of ethanol and 50 grams of diacetone alcohol is added. After a reaction time of 6 hours, the mixture obtained is passed through a PTFE filter having a pore size of 0.2 μm.

Preparation of Aluminum Alkoxide Liquid

The procedure used for the preparation of titanium alkoxide liquid is repeated, with this difference that 5 grams of tripropoxy aluminate (TPOAl) are used instead of 5 grams of TEOTi.

Preparation of Zirconium Alkoxide Liquid

The procedure used for the preparation of titanium alkoxide liquid is repeated, with this difference that 8, 5 grams of tetrabutoxy zirconate (TBOZ) are used instead of 5 grams of TEOTi.

The above solutions are spin coated on to clean glass plates of 10×10 cm at a speed of 200 r.p.m. for 1 minute. The coated glass plates are heated to 150° C. for 20 minutes, thereby forming the cured filtering layers. All filtering layers thus formed are mirror bright, neutral black and exhibit an average transmission of 70±2% between 420 and 680 nm.

All filtering layers are resistant to washing with weak acid, weak base, ethanol, acetone, water and customary cleaning agents. By means of a scratch test, in which a diamond needle is moved several times over the filtering layers with a force of 45 grams, it was established that the abrasion resistance of the filtering layers is satisfactory. After said test no damage to the surface could be observed.

The resistance to light of the filtering layers is tested by means of the so-called Xenotest in accordance with DIN-standards 54003 and 54004, using a Heraeus Suntest CPS apparatus. In this test, the filtering layers are exposed to artificial light corresponding to daylight under indoor conditions, in such a manner that a residence time of the filtering layer of 24 hours in this apparatus corresponds to 1 year of indoor conditions as tested according to DIN-wool standards. The results after an exposure corresponding to 4 years of indoor use (DIN-wool scale 6) are listed in Table 1.

TABLE 1

| alkoxide | relative increase in transmission after 4 years of indoor use (%) |
|---|---|
| TEOG | 4 ± 2 |
| TPOAl | 10 ± 2 |
| TBOZ | 12 ± 2 |
| TEOTi | 24 ± 2 |
| — | 12 ± 2 |

The results listed in Table 1 show that filtering layers of silicon dioxide with incorporated germanium oxide yield an improved light resistance. Oxides of Al, Zr and Ti have no or negative effect on the light resistance and have a positive effect on the resistance of the filtering layer to cleaning liquids. The best results are obtained with germanium oxide. Filtering layers containing germanium oxide are not subject to discoloration (i.e. the relative increase in transmission is less than 10%) after 8 to 10 years of indoor use.

EXEMPLARY EMBODIMENT 2.

In accordance with the method of exemplary embodiment 1, glass plates are provided with filtering layers of silicon dioxide into which zirconium oxide and black dye is incorporated, the zirconium oxide content varying between 5 and 15 mole % in relation to silicon dioxide. To this end, coating liquids having varying TBOZ contents are prepared.

The filtering layer provided must be resistant to cleaning agents and other customarily used liquids. To determine the resistance, drops of ethanol (100%), acetone (100%), acetic acid (50%), ammonium hydroxide (14%), soap solution and salt water are provided on the filtering layer. After the drops have dried the surface of the filtering layer is examined as to whether it has been attacked and/or any dye has been leached. The results regarding leaching are shown in Table 2.

TABLE 2

| mol. % Zr | ethanol | acetone | ammonium hydroxide | acetic acid | salt water | soap |
|---|---|---|---|---|---|---|
| 5 | — | — | + | + | + | + |
| 10 | + | + | + | + | + | + |
| 15 | + | + | + | + | + | + |

In this Table, the symbols have the following meaning:
+ satisfactory resistance to leaching
– poor resistance to leaching.

The best results were obtained by incorporating 10–15 mol. % of zirconium oxide in relation to silicon dioxide. Higher concentrations lead, after several hours at room temperature, to gellification of the alcoholic solutions.

Ammonium hydroxide slightly attacks the filtering layer, except when the filtering layer contains at least 10 mol. % of germanium oxide.

EXEMPLARY EMBODIMENT 3.

A solution is prepared (solution A) from the following constituents:
300 g ethanol
170 g 1-butanol
75 g TEOS
4 g Orasol Black CN™
65 g $HCl/H_2O$ solution (1 mole/1)
This mixture is stirred at room temperature for 1 hour.

In addition, a solution is prepared (solution B) from the following constituents:
55 g ethanol
1.4 g acetylacetone
14 g TBOZ This mixture is also stirred at room temperature for 1 hour. Subsequently, solution B is added to solution A. After stirring for 5 minutes, 80 g of diacetone alcohol is added. The mixture obtained is stirred for 10 minutes and then passed through a PTFE-filter having a pore size of 0,2 $\mu$m.

In the same manner as described in exemplary embodiment 1, the solution obtained is used to coat glass plates.

The layer obtained has an excellent abrasion resistance which is determined by rubbing the filtering layer twenty times with a rubber eraser (Lion special No. 50) with a force of 10 N. After said test, the filtering layer was examined under the microscope (magnetification 100×) and no scratches could be observed.

If, under equal conditions, no acetylacetone is added to the coating solution a few scratches having a width of 2 $\mu$m are visible.

The addition of acetylacetone to the coating solution leads to a coating having a better abrasion resistance, while the other properties are not adversely affected.

EXEMPLARY EMBODIMENT 4.

The Figure diagrammatically shows an exploded perspective view of a cathode ray tube which is known per se and which has a glass envelope 31 comprising a display screen 32, a cone 33 and a neck 34. In the neck there is provided an electron gun 35 for generating an electron beam 36. This electron beam 36 is focused on to a target spot 38 on a phosphor layer 37 on the inner surface of the display screen 32. The electron beam 36 is deflected across the display screen 32 in two mutually perpendicular directions x-y by means of the deflection coil system 39. The outer surface of the display screen 32 is provided with a filtering layer 40 which is manufactured as described in any of the above exemplary embodiments.

The invention enables spectrally neutral filtering layers to be manufactured and provided on a display screen of a display device in a simple manner. Said filtering layers may be mirror bright, are resistant to light and to customary cleaning liquids. Curing the filtering layer at 160° C., a temperature to which display tubes are resistant, results in scratch-resistant layers.

What is claimed is:

1. A method of manufacturing a filtering layer of silicon on a display screen of a display device, characterized in that the filtering layer is manufactured by providing, on the display screen, a coating of a mixture of an alcoholic solution of an alkoxysilane compound, an alkoxy compound of at least one metal selected from the group consisting of Ge, Zr, Al and Ti, acidified water and a black dye and then heating said thus coated display screen to a temperature sufficient to form silicon dioxide from the alkoxysilane compound and to form an oxide of said metal from said alkoxy compound, thereby forming the filtering layer comprising silicon dioxide, an oxide of the metal and the dye.

2. A method as claimed in claim 1, characterized in that a mono-azo chromium complex (Colour Index: Solvent Black 28) is used as the black dye.

3. A method as claimed in claim 1, characterize in that a tetraalkoxy zirconate or tetraalkoxy germanite is used as the alkoxy compound.

4. A method as claimed in claim 1, characterized in that 0.25–1 mole of acetylacetone per mole of alkoxy compound of Ge, Zr, Al or Ti is also added to the alcoholic solution.

5. A method as claimed in claim 1 wherein the display screen coated with the alcoholic solution is heated to a temperature of about 150–160 °C. to form silicon dioxide from the alkoxysilane compound and form an oxide of said metal from said alkoxy compound.

* * * * *